US008116496B2

(12) United States Patent
Gebert et al.

(10) Patent No.: US 8,116,496 B2
(45) Date of Patent: Feb. 14, 2012

(54) EARPIECE FOR A HEARING DEVICE WITH BAYONET FITTING

(75) Inventors: Anton Gebert, Kleinsendelbach (DE); Markus Hörnig, Pinzberg (DE); Hartmut Ritter, Neunkirchen am Brand (DE)

(73) Assignee: Siemens Medical Instruments Pte. Ltd., Singapore (SG)

( * ) Notice: Subject to any disclaimer, the term of this patent is extended or adjusted under 35 U.S.C. 154(b) by 944 days.

(21) Appl. No.: 12/152,572

(22) Filed: May 15, 2008

(65) Prior Publication Data

US 2008/0285783 A1 Nov. 20, 2008

(30) Foreign Application Priority Data

May 16, 2007 (DE) ..... 10 2007 023 055

(51) Int. Cl.
*H04R 25/00* (2006.01)

(52) U.S. Cl. ..... 381/328; 381/322

(58) Field of Classification Search ..... 381/328, 381/322

See application file for complete search history.

(56) References Cited

U.S. PATENT DOCUMENTS

| | | | | |
|---|---|---|---|---|
| 5,002,151 | A * | 3/1991 | Oliveira et al. | 181/130 |
| 5,631,965 | A * | 5/1997 | Chang et al. | 381/72 |
| 7,110,562 | B1 | 9/2006 | Feeley et al. | |
| 7,372,972 | B2 | 5/2008 | Ach-Kowalewski et al. | |
| 2005/0190940 | A1 | 9/2005 | Ach-Kowalewski et al. | |
| 2006/0137934 | A1 | 6/2006 | Kurth | |
| 2006/0153418 | A1 | 7/2006 | Van Halteren | |
| 2007/0009130 | A1 | 1/2007 | Feeley et al. | |
| 2008/0031481 | A1 * | 2/2008 | Warren et al. | 381/322 |

FOREIGN PATENT DOCUMENTS

| | | | |
|---|---|---|---|
| DE | 10 2004 016 577 | A1 | 7/2005 |
| EP | 1569499 | A1 | 8/2005 |
| EP | 1684544 | A2 | 7/2006 |
| WO | 2004025990 | A1 | 3/2004 |
| WO | WO 2004/025990 | A1 | 3/2004 |

* cited by examiner

*Primary Examiner* — Tu-Tu Ho

(57) ABSTRACT

An earpiece for a hearing device is provided with a high retaining force in an ear shell in a repeatedly detachable manner. The earpiece comprising a receiver including a receiver connecting piece at the sound outlet and an ear shell in which the receiver is fixed and which holds the receiver in the ear canal and possesses, when worn in the ear canal, an inner side facing the eardrum and an opposite outer side on which the receiver is detachably fixed. The receiver is attached to the ear shell via a bayonet fitting. A first part of the bayonet fitting is fixedly connected to the receiver connecting piece. A second part of the bayonet fitting is rotated from the inner side of the ear shell to the first part of the bayonet fitting. The bayonet fitting ensures sufficient retention and wear-free releasing and closing.

18 Claims, 3 Drawing Sheets

EARPIECE FOR A HEARING DEVICE WITH BAYONET FITTING

CROSS REFERENCE TO RELATED APPLICATIONS

This application claims priority of German application No. 10 2007 023 055.0 DE filed May 16, 2007, which is incorporated by reference herein in its entirety.

FIELD OF INVENTION

The present invention relates to an earpiece for a hearing device, said earpiece being wearable in the ear canal and comprising a receiver including a receiver connecting piece at the sound outlet and an ear shell in which the receiver is fixed and which holds the receiver in the ear canal and which possesses, when worn in the ear canal, an inner side facing the eardrum and an opposite outer side on which the receiver is detachably fixed. The term "hearing device" is understood here as meaning in particular any ear-wearable device such as a hearing aid, earphones, headset, or the like.

BACKGROUND OF INVENTION

Hearing aids are portable hearing instruments which serve to provide hearing assistance to the hearing-impaired. In order to accommodate the multiplicity of individual requirements, different designs of hearing aid are provided, including behind-the-ear (BTE) and in-the-ear (ITE) hearing aids, e.g. concha or completely-in-canal (CIC) instruments. The hearing devices cited by way of example are worn on the outer ear or in the auditory canal. However, bone conduction hearing aids, implantable or vibrotactile hearing aids are also commercially available. In these cases the damaged hearing is stimulated either mechanically or electrically.

The basic components of a hearing aid are essentially an input transducer, an amplifier and an output transducer. The input transducer is generally a sound pickup device, e.g. a microphone, and/or an electromagnetic pickup such as an induction coil. The output transducer is mainly implemented as an electroacoustic transducer, e.g. a miniature loudspeaker, or as an electromechanical transducer such as a bone conduction receiver. The amplifier is usually incorporated in a signal processing unit.

This basic design is shown in FIG. 1 using the example of a behind-the-ear hearing aid. Installed in a hearing aid housing 1 for wearing behind the ear are one or more microphones 2 for picking up sound from the environment. A signal processing unit 3 which is likewise incorporated in the hearing aid housing 1 processes the microphone signals and amplifies them. The output signal of the signal processing unit 3 is transmitted to a loudspeaker or receiver 4 which outputs an audible signal. The sound is in some cases transmitted to the wearer's eardrum via a sound tube which is fixed in the auditory canal using an earmold. The hearing aid and in particular the signal processing unit 3 are powered by a battery 5 which is likewise incorporated in the hearing aid housing 1.

Also specifically known are receiver-in-canal (RIC) instruments which have a receiver unit for insertion into the auditory canal. These are fitted using not only so-called standardized soft ear tips but also using custom-made ear shells, i.e. earmolds, the receivers being inserted into the standardized or custom ear shell. When removing the receiver unit from the auditory canal, the user typically grips the receiver unit by the receiver or by the signal wire connected thereto. In the case of an earmold that is relatively firmly seated in the auditory canal, a high retaining force between the receiver and the earmold is necessary in order to prevent the entire unit from being pulled apart when the receiver unit is removed from the auditory canal. This high retaining force in turn means that the receiver unit can only be pushed out of the ear shell or more specifically earmold with the aid of a tool ("cherry stone remover") for cleaning purposes and general replacement of the side facing the eardrum (inside of the ear shell). In this process the cerumen protection device disposed in the sound outlet opening is frequently destroyed. In addition, after many replacements both the receiver and the ear shell or more specifically a corresponding adapter become worn or damaged over time. This means that the seal tightness between the receiver and the ear shell is reduced, possibly resulting not only in soiling of the receiver but also in audible feedback.

The publication WO 2004/025990 A1 discloses a hearing aid with an external receiver module. The receiver module consists of an earmold to which a receiver is attached using a specially shaped fixing element which, on the one hand, holds the receiver and, on the other, is screwed to the earmold.

In addition, the publication DE 10 2004 016 577 A1 discloses a headset with hearing aid functionality. An earmold is connected to the headset module using a snap-in or bayonet fitting.

SUMMARY OF INVENTION

The object of the present invention is therefore to provide an earpiece for a hearing device and in particular a hearing aid in which the receiver is fixed in an ear shell with high retaining force on the one hand and in an easily exchangeable manner on the other.

This object is achieved according to the invention by an earpiece for a hearing device, said earpiece being wearable in the ear canal and comprising a receiver including a receiver connecting piece at the sound outlet and an ear shell in which the receiver is fixed and which holds the receiver in the ear canal and which possesses, when worn in the ear canal, an inner side facing the eardrum and an opposite outer side on which the receiver is detachably fixed, the receiver being attached to the ear shell by means of a bayonet fitting, and wherein a first part of the bayonet fitting is fixedly connected to the receiver connecting piece and a second part of the bayonet fitting is rotated from the inner side of the ear shell to the first part of the bayonet fitting.

The bayonet fitting ensures on the one hand a significantly higher retaining force than, for example, a detachable snap-in connection. On the other hand, no locking components are bent or strongly rubbed against one another when closing the bayonet fitting, resulting in little wear and tear.

In the ear shell there is preferably fixed an adapter in which the second part of the bayonet fitting is pivotally mounted. This means that the manner in which the receiver is fixed in the ear shell does not need to be specified already at the time of manufacture of the ear shell.

Another special variant of the earpiece according to the invention consists in that the second part of the bayonet fitting projects from the surface of the ear shell on its inner side, i.e. the side facing the eardrum when it is being worn, and possesses at least two surfaces which are parallel to one another and to the axis of the bayonet fitting. This makes it possible to open the bayonet fitting using a simple tool such as a small pair of pliers, without destroying any cerumen protection device located in the second part of the bayonet fitting.

In addition, the first part of the bayonet fitting can possess a conical section which is cut away accordingly on two opposite sides from the parallel surfaces of the second part of the bayonet fitting. The cone ensures that the receiver is seated in the ear shell coaxially to the sound channel of the ear shell or more specifically of the adapter and at the same time forms part of the bayonet fitting with the cut-away sides.

A seal can also be disposed between the first and second part of the bayonet fitting, thereby sealing it against dirt and interfering sound.

BRIEF DESCRIPTION OF THE DRAWINGS

The present invention will now be explained in greater detail with reference to the accompanying drawings, in which.

DETAILED DESCRIPTION OF INVENTION

The examples described in greater detail below constitute preferred embodiments of the present invention.

Figure 1:
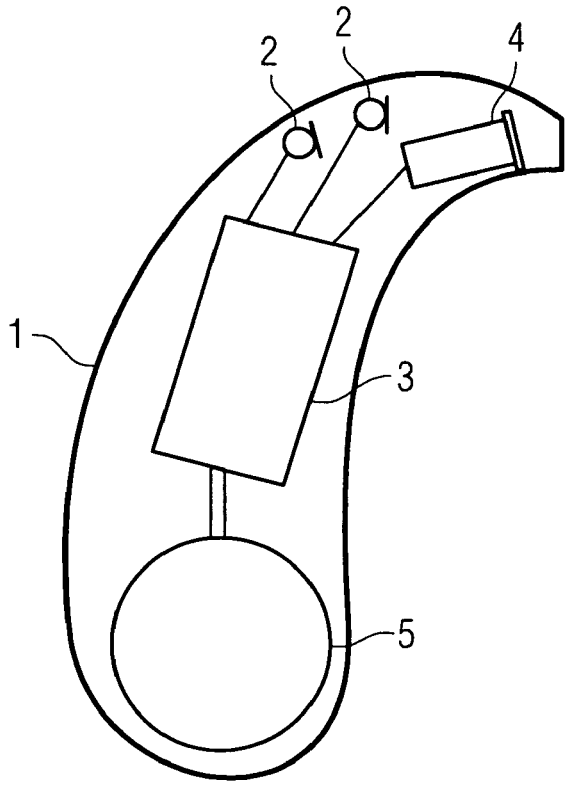
FIG 1 (Prior art)
FIG. 1 is a schematic sketch showing the design of a hearing aid according to the prior art.
Figure 2:
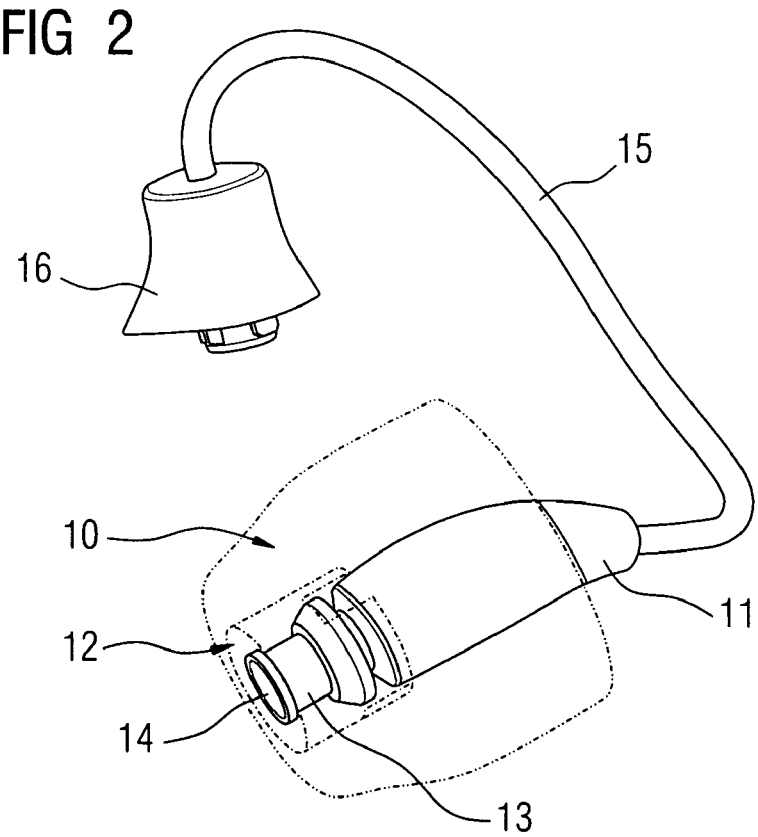
FIG. 2 shows an earpiece with external receiver according to the present invention.

FIG. 2 shows an external receiver unit for connection to a hearing aid main unit that is to be worn behind the ear. The external receiver unit has an earmold 10 in which an external receiver 11 is fixed. The fixing will be explained in more detail in connection with the further FIGS. 3 to 9. It is effected using an earmold adapter 12 and an acoustic seal 13. The sound from the receiver 11 leaves the earmold 10 via a cerumen protection device 14. The receiver 11 is supplied with electrical signals from the hearing aid main unit via a signal wire 15. For this purpose the signal wire 15 is plugged into the hearing aid main unit by means of a connector 16. The fixing of the receiver 11 in the earmold 10 should typically meet the following requirements:

1. "RETENTION": The external receiver 11 shall be fixed in the earmold 10 such that it can be repeatedly detached.

2. "SEALING": The external receiver 11 shall be protected against cerumen, dirt, sweat, etc. In addition, it shall be fixed in the earmold 10 in an acoustically sealed manner so that no sound becomes externally audible.

3. "VIBRATION DAMPING": The vibrations of the receiver 11 relative to the earmold 10 shall be damped. This applies all the more to high-power receivers which make relatively large movements or rather natural oscillations.

4. "INCORPORATING RECEIVER PROTECTION": At the same time the earmold adapter 12 advantageously also functions as a holder for a cerumen protection device.

Figure 3:
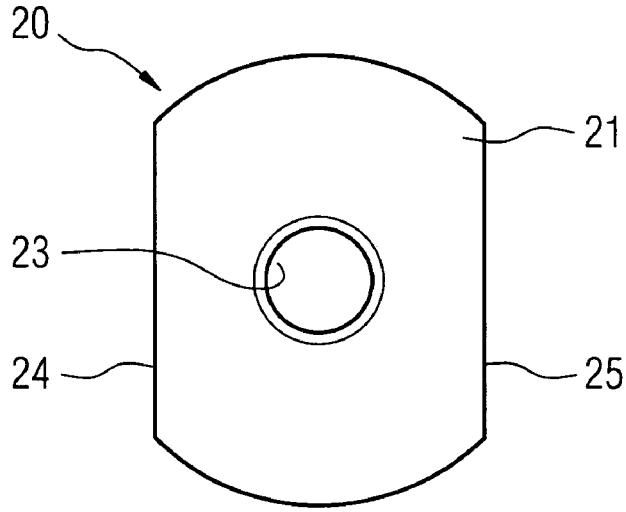
FIG. 3 shows a receiver connecting piece viewed from the sound output side of the receiver.
Figure 4:
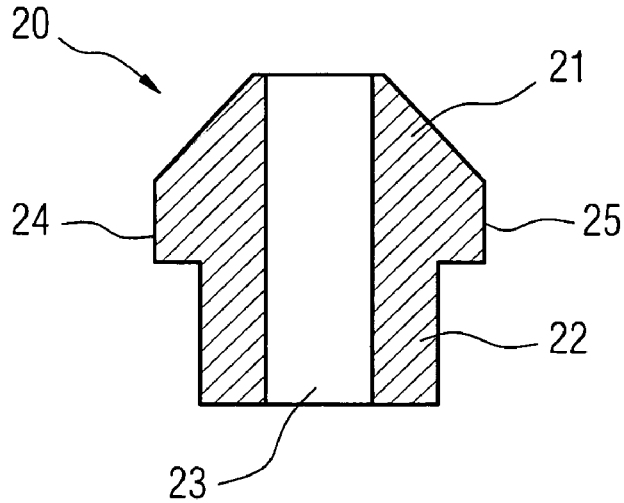
FIG. 4 shows a cross-section through the receiver connecting piece of FIG. 3.
Figure 5:
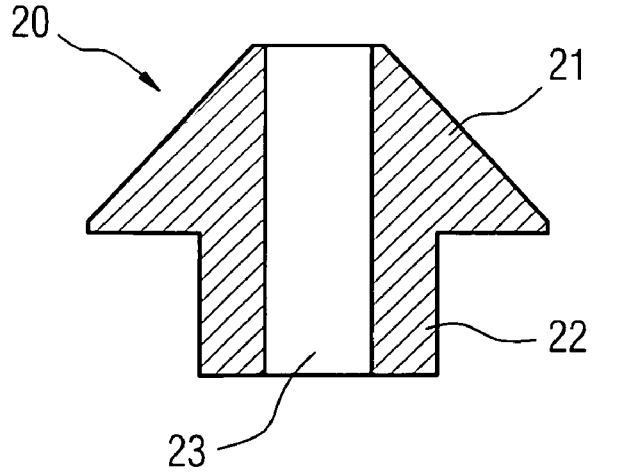
FIG. 5 shows the receiver connecting piece of FIG. 4 rotated through 90°.

The four requirements listed above are inventively fulfilled by an earmold adapter 12 with bayonet fitting. An earmold adapter 12 of this kind is shown in FIGS. 6 to 9. However, the first part of the bayonet fitting which is fixedly connected to the receiver connecting piece will first be explained with reference to FIGS. 3 to 5. FIG. 3 shows said receiver connecting piece 20 from the sound output side. FIGS. 4 and 5 show said receiver connecting piece 20 in cross-section, the sections being rotated through 90° relative to one another. The receiver connecting piece 20 essentially consists of a conical section 21 and a tubular section 22 adjoining the wide part of the cone. A sound channel 23 passes through the conical section 21 and the tubular section 22.

The conical section 21 is cut away on two opposite sides parallel to the cone axis to produce two parallel lateral surfaces 24 and 25. These can be seen both in the plan view in FIG. 3 and in the cross-sectional view in FIG. 4, but not in the 90° rotated view in FIG. 5.

The connection piece 20 is preferably made of a hard plastic.

Figure 6:
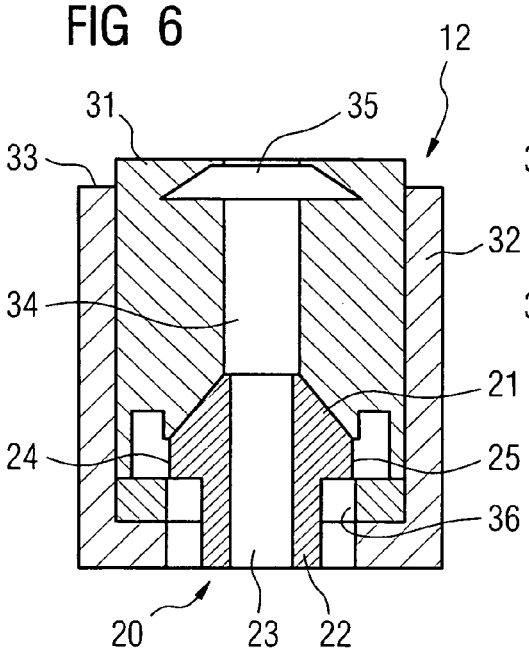
FIG. 6 shows an earmold adapter with receiver connecting piece in the unlocked state.

As shown in FIG. 6, the second part 31 of the bayonet fitting is part of the earmold adapter 12. This second part 31 is pivotally mounted in a hard outer shell 32 of the adapter 12. The adapter shell 32 has an inner side 33 which, when the earpiece is worn in the auditory canal, faces toward the eardrum. A piece of the second part 31 of the bayonet fitting projects from said inner side 33. This can also be seen in FIG. 7 which shows a plan view onto the adapter 12 from this inner side.

Inside the second part 31 of the bayonet fitting there runs, coaxially with the bayonet fitting, a sound channel 34 into which a cerumen protection device 35 is inserted. The receiver connecting piece 20 is pushed into the adapter 12 from the side opposite the inner side 33. During insertion the lateral surfaces 24 and 25 can pass a corresponding recess 36 of the second part 31 of the bayonet fitting. Said recess 36 can be seen in FIG. 7 and is in one dimension only slightly larger than the distance between the two lateral surfaces 24 and 25. In addition, the recess 36 is large enough in the second dimension to ensure that the conical section 21 of the receiver connecting piece 20 can be pushed through the recess 36 even with its uncut radii 39.

Figure 8:
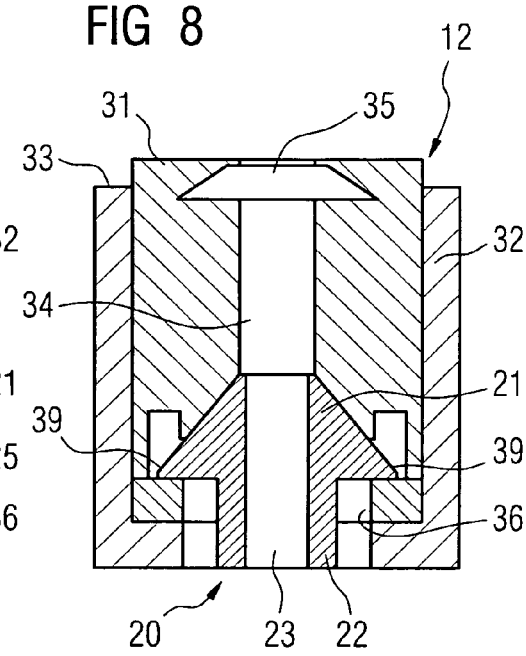
FIG. 8 shows the earmold adapter of FIG. 6 in the locked state.
Figure 7:
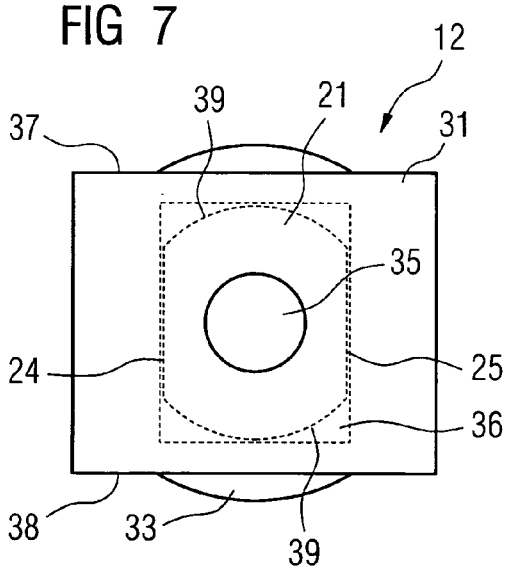
FIG. 7 shows the earmold adapter of FIG. 6 on the sound output side.
Figure 9:
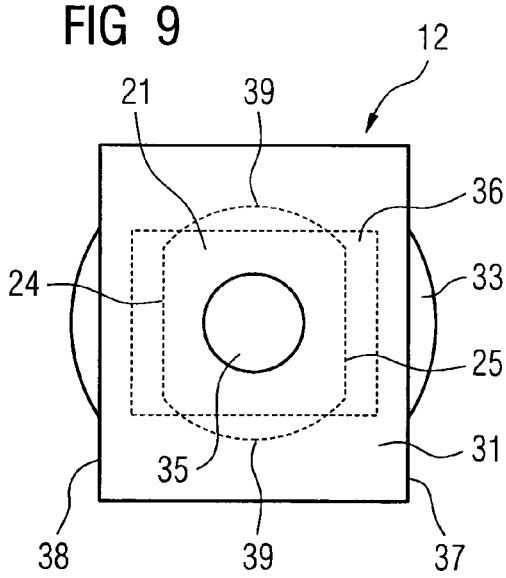
FIG. 9 shows the earmold adapter of FIG. 8 viewed from the sound output side.

In the customary manner for bayonet fittings, after the receiver connecting piece 20 has been pushed in, the second part 31 is rotated through a certain angle, in this case 90°. In order to be able to rotate the second part 31 easily, it has at least two flattened sides 37, 38 which project from the inner side 33, thereby enabling the second part 31 of the bayonet fitting to be easily gripped and turned e.g. using a simple pair of pliers or fitting aid. The rotated state of the bayonet fitting is shown in FIGS. 8 and 9. In the sectional view in FIG. 8 it can now be seen that the recess 36 is engaged from behind by the conical section 21. This means that the receiver connecting piece 20 is now firmly anchored in the adapter 12. This anchoring is shown schematically in the plan view in FIG. 9. A rounded section 39 of the conical section 21 projects beyond the recess 36 so that the bayonet fitting is closed and the receiver connecting piece 20 is anchored in the adapter 12.

Between the conical section 21 of the receiver connecting piece 20 and the second part 31 of the bayonet fitting there can be disposed a seal 13 (not shown in drawings 6 and 8 but visible in FIG. 2). With the aid of this soft seal relative to the receiver connecting piece 20 and the outer shell 32, the cone 21 is sealed with the fitting on the receiver sound outlet side. This soft part at the same time enables the force for opening and closing the bayonet fitting to be adjusted.

Another alternative design of the external receiver, i.e. of the earpiece according to the invention, consists in that no separate adapter 12 is used, but the second part 31 of the bayonet fitting is pivotally mounted directly in the ear shell.

With the above-described design of an earpiece and receiver coupled to one another by means of a bayonet fitting, the receiver 11 can be removed with much less force from the ear shell or more precisely the earmold 10, leaving the receiver unit undamaged. In addition, a cerumen protection device 35 can also be inserted in the earpiece or more precisely in the adapter 12 without it having to be replaced each time the receiver is removed. Daily cleaning of the "receiver and earmold" unit is therefore possible.

The invention claimed is:

1. A hearing device earpiece that is wearable in the ear canal, comprising:

a receiver including a receiver connecting piece at a sound outlet; and an ear shell in which the receiver is detachably attached and which holds the receiver in the ear canal and which possesses, when worn in the ear canal, an inner side facing the eardrum and an opposite outer side to which the receiver is detachably attached via a bayonet fitting, wherein a first part of the bayonet fitting is fixed to the receiver connecting piece, and a second part of the bayonet fitting is rotated from the inner side of the ear shell to the first part of the bayonet fitting, wherein the ear shell has a fixed adapter in which the second part of the bayonet fitting is pivotally mounted, and wherein the second part of the bayonet fitting projects from the surface of the ear shell on the inner side and possesses at least two surfaces which are parallel to one another and to the axis of the bayonet fitting.

2. The earpiece as claimed in claim 1, wherein a sound channel into which a cerumen protection device is inserted passes through the second part of the bayonet fitting.

3. The earpiece as claimed in claim 1, wherein the first part of the bayonet fitting includes a conical section which is cut away correspondingly on two opposite sides of a recess of the second part of the bayonet fitting.

4. The earpiece as claimed in claim 1, wherein a seal is disposed between the first and the second part of the bayonet fitting.

5. A hearing device earpiece that is wearable in the ear canal, comprising:

a receiver including a receiver connecting piece at a sound outlet; and an ear shell in which the receiver is detachably attached and which holds the receiver in the ear canal and which possesses, when worn in the ear canal, an inner side facing the eardrum and an opposite outer side to which the receiver is detachably attached via a bayonet fitting, wherein a first part of the bayonet fitting is fixed to the receiver connecting piece, and a second part of the bayonet fitting is rotated from the inner side of the ear shell to the first part of the bayonet fitting, wherein the second part of the bayonet fitting projects from the surface of the ear shell on the inner side and possesses at least two surfaces which are parallel to one another and to the axis of the bayonet fitting.

6. The earpiece as claimed in claim 5, wherein a sound channel into which a cerumen protection device is inserted passes through the second part of the bayonet fitting.

7. The earpiece as claimed in claim 5, wherein the first part of the bayonet fitting includes a conical section which is cut away correspondingly on two opposite sides of a recess of the second part of the bayonet fitting.

8. The earpiece as claimed in claim 5, wherein a seal is disposed between the first and the second part of the bayonet fitting.

9. The earpiece as claimed in claim 5, wherein the ear shell has a fixed adapter in which the second part of the bayonet fitting is pivotally mounted.

10. The earpiece as claimed in claim 6, wherein the first part of the bayonet fitting includes a conical section which is cut away correspondingly on two opposite sides of a recess of the second part of the bayonet fitting.

11. The earpiece as claimed in claim 8, wherein the first part of the bayonet fitting includes a conical section which is cut away correspondingly on two opposite sides of a recess of the second part of the bayonet fitting.

12. The earpiece as claimed in claim 9, wherein the first part of the bayonet fitting includes a conical section which is cut away correspondingly on two opposite sides of a recess of the second part of the bayonet fitting.

13. The earpiece as claimed in claim 6, wherein a seal is disposed between the first and the second part of the bayonet fitting.

14. The earpiece as claimed in claim 7, wherein a seal is disposed between the first and the second part of the bayonet fitting.

15. The earpiece as claimed in claim 9, wherein a seal is disposed between the first and the second part of the bayonet fitting.

16. The earpiece as claimed in claim 6, wherein the ear shell has a fixed adapter in which the second part of the bayonet fitting is pivotally mounted.

17. The earpiece as claimed in claim 7, wherein the ear shell has a fixed adapter in which the second part of the bayonet fitting is pivotally mounted.

18. The earpiece as claimed in claim 8, wherein the ear shell has a fixed adapter in which the second part of the bayonet fitting is pivotally mounted.

* * * * *